United States Patent [19]

Funkhouser

[11] 4,404,901

[45] Sep. 20, 1983

[54] STRIKER ASSEMBLY FOR LINE PRINTERS

[75] Inventor: Richard L. Funkhouser, Melbourne, Fla.

[73] Assignee: Documation Incorporated, Palm Bay, Fla.

[21] Appl. No.: 15,213

[22] Filed: Feb. 26, 1979

[51] Int. Cl.[3] ..... B41J 9/42

[52] U.S. Cl. ..... 101/93.02; 101/93.03

[58] Field of Search ..... 101/93.02, 93.29, 93.33, 101/93.34, 93.48; 400/454, 455, 457

[56] References Cited

U.S. PATENT DOCUMENTS

| | | | |
|---|---|---|---|
| 2,997,632 | 8/1961 | Shepard | 101/93.33 X |
| 3,200,739 | 8/1965 | Antonucci | 101/93.34 |
| 3,266,418 | 8/1966 | Russo | 101/93.34 |
| 3,282,203 | 11/1966 | Kalbach et al. | 101/93.33 |
| 3,636,865 | 1/1972 | Konkel et al. | 101/93.33 |
| 3,919,933 | 11/1975 | Potter | 101/93.02 X |
| 4,075,943 | 2/1978 | Johnston | 101/93.02 X |
| 4,164,180 | 8/1979 | Ellefson et al. | 101/93.34 |

*Primary Examiner*—Edward M. Coven

*Attorney, Agent, or Firm*—Duckworth, Allen, Dyer & Pettis

[57] ABSTRACT

A striker assembly for operating the printing hammer in a high speed impact-type line printer. The assembly is a simple, low cost unit having a minimum of components. The striker body is of one-piece molded construction having a head and neck portion. An armature backstop is carried in the head portion which may be externally adjusted for printer character alignment during operation of the line printer by exerting pressure on the head portion with resulting flexure of the neck. The backstop is self-aligning during such adjustment. The striker assembly is mounted to permit adjustment of printed character density during operation of the line printer.

11 Claims, 7 Drawing Figures

STRIKER ASSEMBLY FOR LINE PRINTERS

BACKGROUND OF THE INVENTION

1. Field of the Invention

The present invention relates to printing hammer assemblies for high speed line printers which utilize a fast moving steel character band and high speed hammer assemblies for hitting the band at the location of the appropriate characters on the band to print upon the band and especially to a low cost striker assembly for actuating the hammer and having an externally adjustable back stop.

2. Description of the Prior Art

The present invention is related to and constitutes an improvement on the high speed printer hammer assembly disclosed in U.S. Pat. No. 4,121,518 to Prior, et al and assigned to the assignee of the instant application. The aforementioned patent is hereby incorporated by reference into this application.

In the impact printing field, a wide variety of printing techniques have been used in the past including those employed in the common typewriter; drum printer; the wheel printer; and the chain or belt printer. In the present type of printer, an endless steel character band having various characters of the alphabet, as well as numbers embossed upon the band, is rotated between a drive pulley and an idler pulley. As the band is driven at high speeds adjacent a platen, a bank of parallel hammers is driven at a high speed at the moment the particular desired character is passing on the band to print the character upon the paper. The print hammer actuators are typically electromagnetically actuated, which magnets are energized by the driving circuit for each pass of the character band. The hammer assemblies need to be spaced close to each other so that a large bank of hammers can fire as the band is passing; and each hammer must respond rapidly in view of the fast moving band which might otherwise smear the character if the hammer is operating at too slow a speed.

An element of such printing hammer assemblies is a striker assembly which comprises the electromagnetic actuating device and a striker utilized to drive the printing hammer. Of key importance to the speed of operation and registration of the printed letters is the exact at-rest position and the operated position of the striker. It is necessary to provide a backstop against which the striker armature rests in the non-operate position and in operation of a high speed printer, on occasions, the backstop must be adjusted to maintain correct operation thereof. Due to the large number of printing hammer assemblies in the banks of assemblies, it has been necessary in the past to partially disassemble this section of the line printer in order to readjust the backstop of a striker armature. Accordingly, the present invention is directed toward a novel and low cost striker assembly having a unique backstop adjustment which may be adjusted externally from the assembly without any disassembly whatsoever.

The above referenced patent application cites a number of U.S. Patents teaching various types of printer hammer assemblies. Additionally, the following also disclose other variations of high speed printing hammer assemblies: U.S. Pat. Nos. 3,968,744 to Kasu, et al.; 3,964,384 to Johnston; and 3,605,611 to Konkel, et al. These prior art patents show adjustment means for the home position of the striker or print hammer; however, none appear to allow accurate adjustment without partial disassembly of their mechanisms.

SUMMARY OF THE INVENTION

A major element of the present invention which provides unique advantages is the striker base. The base is a one-piece molded framework having imbedded inserts for attaching to a striker mounting plate. The striker base also has provisions for pivoting a striker armature and for supporting a magnet core assembly utilized to operate the armature. A self-aligning backstop is disposed in a head portion of the striker base such that the armature in its non-operated or home position is held tightly against the backstop by a hammer return spring. The backstop is a cylindrical body having a flat side parallel to the longitudinal axis of the cylinder and is disposed in friction bearing surfaces molded into the striker base. Thus, the backstop is rotatable in the striker base head portion. At the urging of the hammer return spring, the armature is forced against the flattened side of the backstop causing it to rotate slightly so as to maintain alignment between the flat side and the back of the armature.

The striker base head portion is attached to the body portion of the striker base by a narrowed neck section. By choice of a proper material for molding of the striker base, the neck thereby forms a flexure area allowing slight movement between the head and body of the striker base. An adjustment screw is disposed in the body section bearing on a portion of the head section. Adjustment of this screw forces the head portion to move slightly with respect to the body portion through flexing of the neck section. Such movement forces the backstop forward against the back of the armature. Movement of the armature with respect to the magnet core assembly which is mounted on the striker base body thereby reduces the air gap, affecting armature travel and speed of operation of the hammer. Thus, adjustment of the adjusting screw allows accurate setting of the required air gap and armature position.

The self-aligning backstop previously described will rotate slightly in its bearing surfaces from the spring pressure against the armature. This action advantageously maintains the flat portion of the backstop in parallel alignment with the back surface of the armature.

The manner of mounting the striker base on the striker mounting plate is such that a first opening in the mounting plate communicates externally to the backstop adjusting screw disposed in the striker base body. Therefore, an operator may perform the required adjustment by use of a screwdriver or similar tool inserted in the communicating opening through the striker mounting plate with no disassembly of the printer mechanism being required. The striker mounting plate provides a groove for accepting the striker base with a securing screw for holding in place. A notch in the mounting face of the striker base faces a second opening in the mounting plate and an eccentric tool may be inserted therein to allow a lateral adjustment of the striker base prior to final tightening of the holding screw.

The molded striker base may be fabricated at low cost and consists of one piece only, replacing several separate machined elements of prior art printing hammer assemblies. This feature has made available to the industry a high speed printer having a very significant reduction in costs over previously available printers.

The striker mounting plate is arranged to accept a plurality of striker assemblies arranged in staggered parallel rows providing a means of operating hammers at any line speed.

It is therefore a principal object of the invention to provide a simplified low cost striker assembly for actuating the hammer in a high speed line printer hammer assembly, wherein means is provided to adjust the striker armature backstop without disassembly of the hammer assembly.

It is another object of the invention to provide a backstop element in such striker assembly having a flat resting surface for the striker armature in its unoperated position in which the alignment of such flat surface is automatically maintained when adjustments are made to the backstop position.

It is still another object of the invention to provide a novel striker base having a backstop disposed therein in which the relative position of the backstop may be varied with respect to the body of the striker base through a flexing action of the material from which the striker base is formulated.

It is yet another object of the invention to provide a striker base moldable from a material having a slight flexing capability and without other moving parts.

It is a further object of the invention to provide a mounting for a striker base that will permit an external lateral adjustment of the striker base.

These and other objects and advantages of the invention may be understood from the following detailed description when viewed in light of the drawings.

DESCRIPTION OF THE PREFERRED EMBODIMENT

Figure 1:
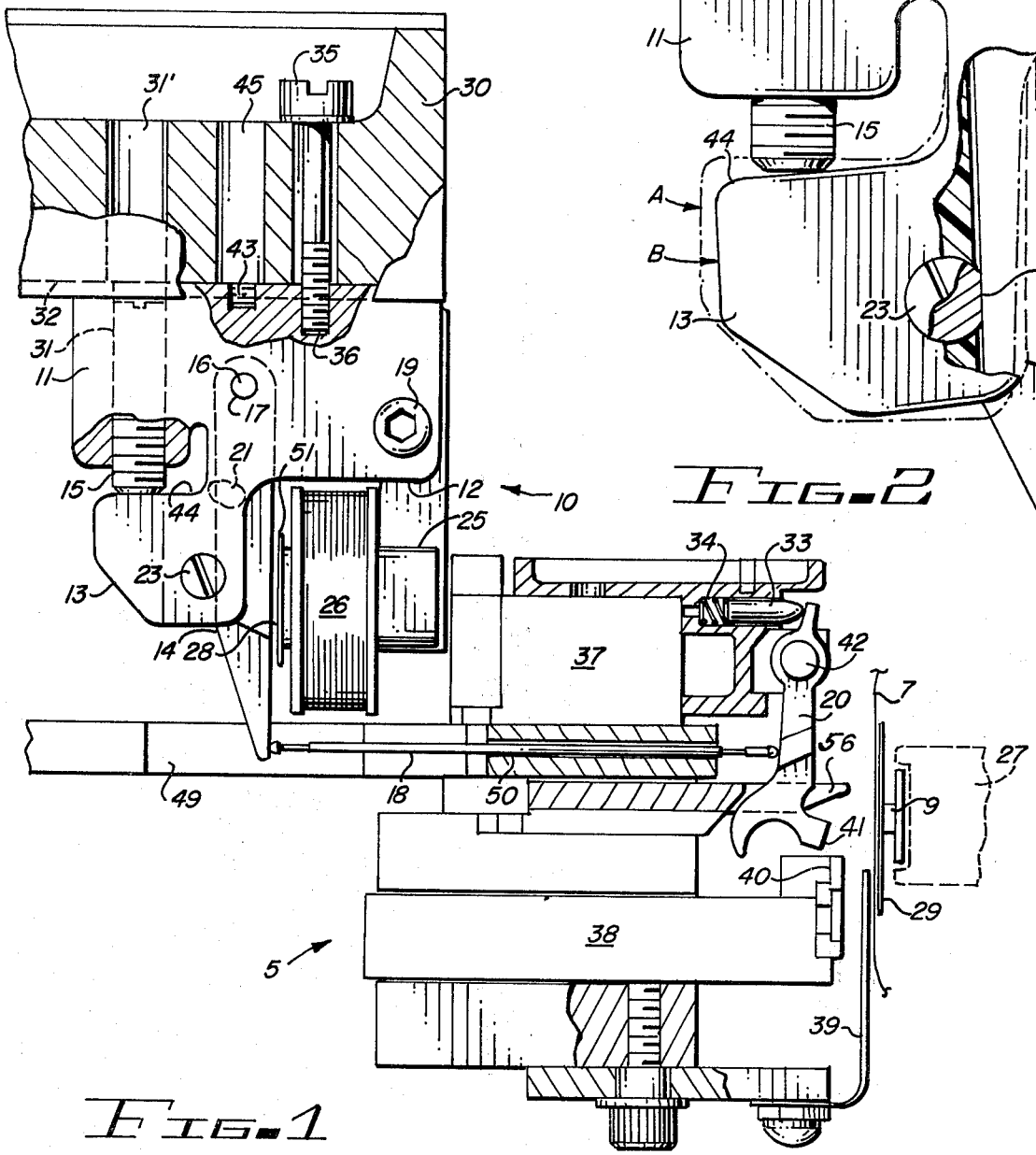
FIG. 1 is a sectional view of a printing hammer assembly showing the striker assembly.

Referring now to FIG. 1, a hammer assembly 5 for a high speed line printer is shown mounted adjacent to a striker assembly 10 attached to mounting plate 30. Hammer assembly 5 has a high speed endless character band 9, shown in cross-section rotating in front of paper 7 between a pair of rollers (not illustrated) and adjacent a platen 27 indicated by the dashed lines. The hammer assembly 5 is driven by a striker assembly 10 having a striker armature 14. Striker armature 14 is mounted to a striker base 12 by an armature pivot pin 16 which allows the end portion of striker armature 14 to drive a push rod 18, which in turn pushes a hammer 20 causing hammer surface 41 to be driven towards the character band 9. Paper 7 rides between character band 9 and inked ribbon 29, and the hammer 20, so that hammer 20 is actuated in the proper sequence for a predetermined character on the character band 9 passing in front of the hammer and prints the character on the paper 7.

Figure 4:
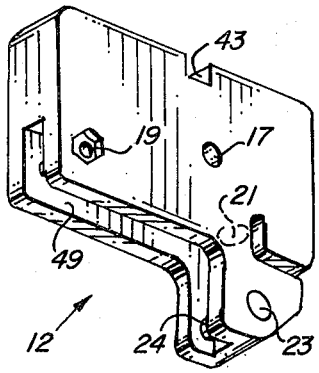
FIG. 4 is a perspective view of the striker base from one side thereof.
Figure 5:
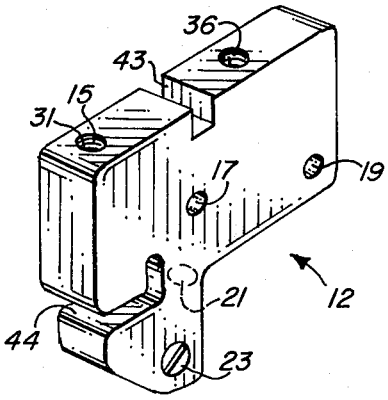
FIG. 5 is a perspective view of the striker base of FIG. 4 from the opposite side.

Of particular importance in striker assembly 10 is striker base 12. With reference now to FIGS. 4 and 5, the construction of striker base 12 may be seen. Striker base 12 consists of a body portion 11 and a head portion 13 with the head portion connected to body portion 11 by flexure neck 21. Striker base 12 is preferably a molded unit fabricated from a material which will allow slight flexing of neck area 21. For example, the material may be polyphenolene sufide resin with 30% carbon fiber filling. For the neck area 21 to flex without cracking, it is important that the molded striker base 12 be properly heat treated by annealing after molding. It has been found satisfactory to hold the base 12 in a jig to prevent warping and to reheat the molded base to approximately 350° F., thereby relieving stresses in the material ensuring proper flexing. Molded into striker base 12 is boss 17 for receiving armature pivot pin 16 with a slotted region 49 adapted to receive armature 14. Slotted region 49 also provides for mounting of magnet core assembly 25 seen in FIG. 1 with mounting hole 19 therein provided. Also seen in FIG. 4 and FIG. 5 is backstop 23 disposed in head section 13 of striker base 12, with backstop 23 described more fully hereinbelow. Also in striker base 12, threaded insert 36 is provided to accept a mounting screw 35. Passage 31 contains a threaded insert for accepting backstop adjustment screw 15, best seen in FIGS. 1 and 2.

Figure 2:
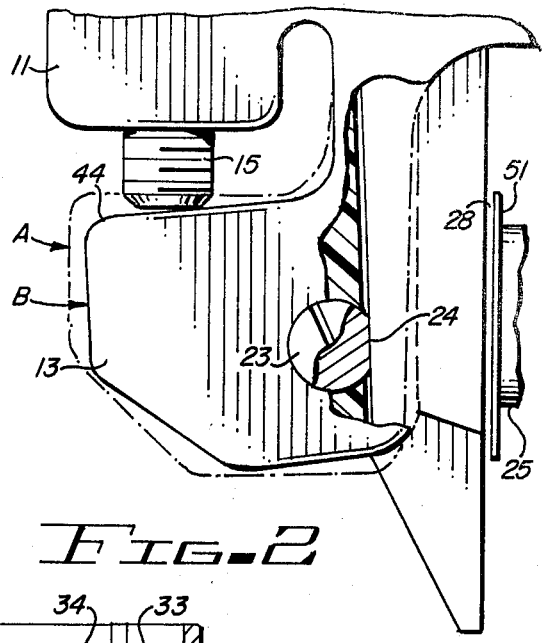
FIG. 2 is a partial view of the striker base showing the striker base head and neck area illustrating the flexing action upon adjustment of the backstop.
Figure 3:
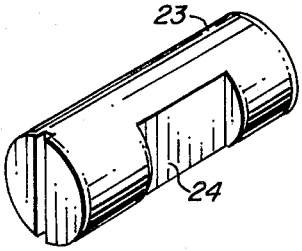
FIG. 3 is a perspective view of the backstop.

Turning back to FIG. 1, the sectional view illustrates adjustment screw 15 bearing on face 44 of head 13. Turning adjustment screw 15 clockwise against face 44 produces a force tending to move head 13 essentially at right angles to the direction of motion of adjusting screw 15. Referring to FIG. 2, broken line A illustrates the position of head portion 13 with no pressure from adjusting screw 15 while the solid line outline of head 13 at B shows the position of head 13 under pressure from adjusting screw 15, somewhat exaggerated for clarity. As such adjustment is made, backstop 23 shown in detail in FIG. 3 comes into play. Backstop 23 may be a short cylinder of a suitable plastic with a central flat area 24 parallel with the axis of the body 23. As noted, backstop 23 is inserted into boss type bearings in the head portion 13 of striker base 12. One end of backstop 23 is slotted to accept a screwdriver or similar tool. During assembly of striker assembly 10, backstop 23 is adjusted by means of the slotted end to place flat area 24 against the rear surface of armature 14 as may be noted from FIG. 2. The backstop 23 is arranged to have a snug fit in its boss bearing surfaces such that it will rotate with slight rotational force applied thereto. Therefore, when an adjustment is made by moving head 13, as illustrated in FIG. 2, such action would tend to change the parallel relationship of 24 with the back surface of striker armature 14. However, by virtue of a rearward force exerted via push rod 18 from hammer return spring 34 this small misalignment of surface 24 will result in slight rotation of backstop 23 bringing the two surfaces back into alignment. As may now be seen, this feature advantageously provides a self-alignment operation with respect to backstop 23 and armature 14 as a backstop adjustment is made with adjusting screw 15.

Figure 6:
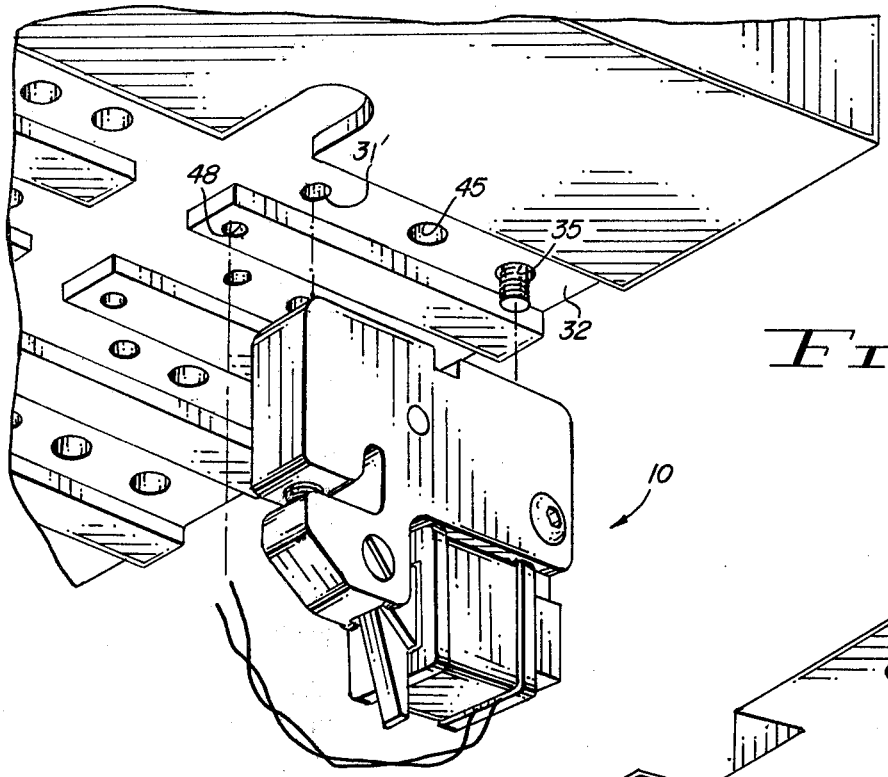
FIG. 6 is a partial view of the striker mounting plate with the striker assembly shown in relative position for mounting.

It is an important feature of this invention that such backstop adjustments may be made externally without dismantling of the printing hammer assemblies. As seen in FIG. 1, a passage or opening 31' is provided in striker mounting plate 30 essentially concentric with and communicating with passage 31 in striker base 12. Therefore, access to adjusting screw 15 is obtained via passage 31'. Striker mounting plate 30 as noted in FIG. 6 provides a series of recessed slots 32 into which the top end of striker base 12 may fit. The top side of striker mounting plate 30 is made easily accessible in the overall high speed line printer assembly. Lateral alignment notch 43 is provided in striker base 12 to allow initial positioning of the printing hammer 20 with respect to band 9. A passage or opening 45 as seen best in FIG. 1 is immediately above notch 43. By use of an eccentric tool inserted into notch 43 through opening 45, striker base 12 may be shifted slightly back and forth with mounting screw 35 slightly loosened. When proper alignment is achieved, screw 35 is tightened. If, at a future date, readjustment of this alignment is required, the invention allows this adjustment to also be made without disassembly of the printing hammer assemblies. Opening 48 in plate 30 is used to feed leads from the magnet assembly of striker assembly 10 through plate 30.

Figure 7:
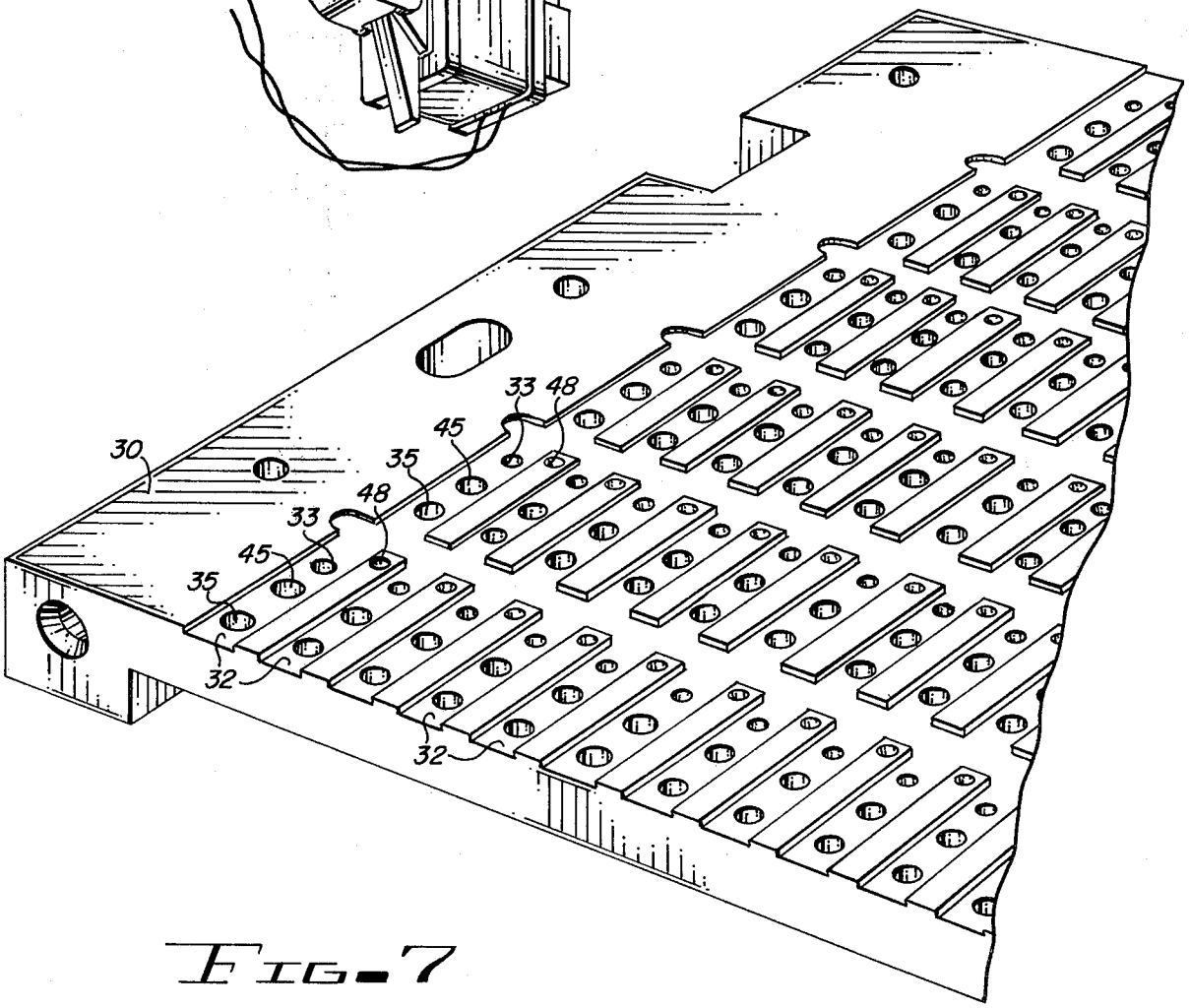
FIG. 7 is a perspective view of the lower surface of the striker mounting plate showing the plurality of striker base mounting grooves in accordance with the invention.

In one application of the invention, 132 hammer assemblies are utilized. The mounting base with its bottom surface shown in FIG. 7 accordingly provides six rows of mounting slots 32 for accepting 22 striker assemblies 10 in each row. The rows are slightly staggered to permit push rods 18 to be disposed in parallel. It is to be understood that a row of 132 hammer assemblies 5 is aligned along the band 9 with a hammer at each letter position of a print out line. The push rods 18 vary in length according to the row in which the striker assembly 10 operating that hammer is installed. The assembly shown in FIG. 1 is for the shortest push rod 18 with striker assembly 10 installed in the first row. Hammer assembly 5 is supported by frame section 49 having passages 50 for carrying push rods 18. Striker assembly 10 for each hammer assembly 5 is thus independently mounted with respect to its hammer assembly 5 and can be moved laterally in groove 32, changing the position of hammer 20. As may also be noted from FIG. 1, adjustment of backstop 23 by screw 15 changes the air gap 28, and consequentially, the length of stroke of push rod 18.

In FIG. 1, air gap 28 between striker armature 14 and the magnet pole piece for assembly 25 may be noted. The residual air gap required for operation of the striker magnet 25 is maintained by stretching a polyimide film ribbon 51 over the pole pieces of each striker assembly 10 in a row on mounting plate 30, with the ribbon tightly secured at each end of the row. As may now be recognized, the air gap 28 in the operated position of magnet assembly 25 is maintained by film 51 and the non-operated position air gap may be accurately and easily adjusted externally by adjusting screw 15.

Returning now to the hammer operation, it may be noted that hammer 20 is supported on hammer support frame 27 with cylindrical plunger 33 and hammer return spring 34 serving to return the hammer to its rest position after an operation. Hammer 20 as well as the bank of adjacent hammers operate within guide comb 56, which is mounted to hammer frame 37 and maintains the line of hammers in horizontal alignment and which looks similar to a hair comb with protruding tines. Impression control pad 40 determines the amount of forward travel of hammer 20 and to some extent the force to which it strikes paper 7 against character band 9. Pad 40 is mounted upon impression control support frame 38. Paper guide 39 serves to compress the forms or paper being printed upon.

Having explained the features and operation of the printing hammer assembly in accordance with the invention, the use of the novel external adjustment features will now be discussed. In prior art high speed line printers, adjustments are commonly made with the machine non-operating using gauges. A line printer utilizing the present invention can be adjusted with the printer in normal operation with observation of the results providing an indication of correct adjustment. The following steps are followed:

1. A dust cover is snapped off of the top side of mounting plate 30 giving access to adjustment openings 31' and 45.
2. The printer is placed in operation and a test program run which prints a permutating pattern of characters for the full width of each line.
3. The nature of the characters being printed at each position along the line is examined for a printout of several lines. The resulting matrix of characters will show clearly a too dark character or too light character by virtue of the contrast with the characters in other positions forming a background. Such a misadjustment is corrected by loosening holding screw 35 for the striker base associated with that character. An eccentric adjusting tool is inserted in opening 45 of mounting base 30, engaging notch 43 in striker base 12. The base 12 is then moved slightly backward or forward, observing the print density as the printer operates, until the density is even with respect to the other lines. Screw 35 is tightened, completing this adjustment.
4. The alignment of each character of a line is examined for centering with respect to adjacent characters. If the character is off center to the left, the length of travel of armature 14 is short; while off center to the right indicates excessive armature travel. A screwdriver is inserted in opening 33 of mounting base 30 and backstop screw 15 adjusted while observing the printout in that line position. Correct adjustment is obtained when the character is properly centered.

As may now be seen, density and alignment adjustments for a high speed impact printer utilizing the invention can be quickly and easily made by relatively unskilled personnel with the printer operating in a test mode, and without disassembly of the printer.

These advantages obtain from the new and novel printing hammer assembly for high speed line printers herein disclosed. In particular, a striker assembly is taught having a minimum number of parts and capable of being constructed at relatively low cost. In addition, the striker assembly provides a simple and effective means for externally adjusting the striker armature backstop to maintain a required home position air gap with respect to the magnet pole piece. The striker base used advantageously utilizes the flexure characteristics of its material to provide a rugged and high-tension restraining force for such backstop adjustment. In other words, once an adjustment has been effected, the tension against the adjusting screw from this flexure action obviates drift or change in adjustment even with the usual vibration and shock in the high speed operation of the printer hammer assemblies. In addition, the backstop itself features a means of self-alignment, varying its relative angle for any specific backstop setting. The mounting base and striker base additionally provide a convenient means of fore and aft adjustment to control print density.

The present invention, however, is not to be construed as limited to the particular forms described herein, which are to be considered illustrative rather than restrictive.

I claim:

1. In a high speed printer having a plurality of hammers utilized in a printing operation and a plurality of associated striker assemblies supporting striker armatures for driving said hammers against a moving character band during such printing operating, a striker assembly comprising in combination:

a striker base having a body portion and a head portion attached to said body portion by a narrow neck section;

a striker armature attached at a pivot point to said striker base;

a self-aligning cylindrical backstop disposed in said head portion and aligned with said striker armature for maintaining said armature in a desired non-operated position; and external adjustment means for adjusting said backstop to maintain said armature in such desired non-operated position during normal operation of said printer.

2. The striker assembly as defined in claim 1 in which:

said narrow neck section permits movement of said head portion with respect to said body portion; and said external adjustment means is an adjusting screw threadedly disposed in said striker base body portion, said screw bearing on said head portion so as to urge such movement of said head portion in response to adjustment of said screw via flexure of said neck section.

3. The striker assembly as defined in claim 2 which further comprises spring means for returning said striker armature to its non-operated position following a striker operation.

4. In a high speed printer having a plurality of hammers utilized in a printing operation and a plurality of associated striker assemblies supporting striker armatures for driving said hammers against a moving character band during such printing operation, a striker assembly comprising in combination:

a striker base having a body portion and an adjustable head portion attached to said body portion by a narrow neck section;

spring means for returning said striker armature to its non-operated position following a striker operation;

a cylindrical backstop disposed in said head portion and aligned with said striker armature, said backstop having a flat central section thereof parallel to the longitudinal axis of said cylinder, and rotatable in said head portion so as to present said flat section to the back of said striker armature wherein said spring means forces said back of said arm against said flat section causing said cylinder to slightly rotate on occasion so as to maintain an aligned relationship therebetween for any adjusted position of said head portion.

5. In a high speed printer having a plurality of hammers utilized in a printing operation and a plurality of associated striker assemblies supporting armatures for driving said hammers against a moving character band during such printing operation, a striker assembly comprising in combination:

a striker mounting plate for mounting of a plurality of aligned striker assemblies;

a striker base having a body portion; and a head portion attached to said body portion by a narrow neck section;

a striker armature attached to a pivot point in said striker base;

a self-aligning cylindrical backstop disposed in said head portion and aligned with said striker armature for maintaining said armature in a desired non-operated position; and external adjustment means for adjusting said backstop to maintain said arm in such desired non-operated position during operation of said printer;

said striker mounting plate having an opening for providing external access to said adjustment means.

6. The assembly as defined in claim 1, or in claim 5, in which said striker base is made of a carbon fiber-filled polyphenylene sulfide resin.

7. The assembly as defined in claim 5 in which:

said striker mounting plate includes a plurality of grooves, each of said grooves adapted to accept a striker base, and which further comprises external alignment means for lateral alignment of a striker base in said groove to a desired position during operation of said printer.

8. The assembly as defined in claim 7 in which said external alignment means includes a notch in said body portion; and said striker mounting plate includes an opening communicating with said notch whereby an adjusting tool can be externally inserted via said opening to engage said notch for laterally shifting said striker base to the desired position, whereby said striker assembly is externally adjustable via said opening during normal operation of said printer.

9. A plurality of printer striker assemblies mounted adjacent to each other comprising:

a plurality of striker bases, each of said striker bases having a head portion and a body portion;

a plurality of armatures, each armature being pivotally mounted in one of said striker bases;

a magnet pole assembly attached to each striker base, and located adjacent to an armature;

a cylindrical backstop disposed in said head portion of each of said striker bases, said cylindrical backstop having a flat surface for contacting a face of said armature when said armature is in a non-operative position, said cylindrical backstop including means for self-alignment of said flat surface with said face of the armature; and an adjustment screw threadably disposed in said striker base and bearing on said head portion, said screw arranged to produce a small movement of said head portion from a turning of said screw for adjusting said backstop to maintain said armature in a desired non-operative position, said adjustment screw adjustable during operation of said plurality of striker assemblies.

10. The apparatus as defined in claim 9 in which said striker base is of one-piece molded construction of polyphenolene sulfide resin with carbon fiber filler, said resin flexing during such movement of said head portion.

11. The apparatus as defined in claim 10 in which said striker base is heat treated after molding to permit flexing of said resin without cracking.

* * * * *